US005931217A

United States Patent [19]

Fernstrum

[11] Patent Number: 5,931,217

[45] Date of Patent: Aug. 3, 1999

[54] MARINE HEAT EXCHANGER

[75] Inventor: Paul W. Fernstrum, Menominee, Mich.

[73] Assignee: R.W. Fernstrum & Company, Menominee, Mich.

[21] Appl. No.: 09/081,278

[22] Filed: May 20, 1998

[51] Int. Cl.[6] ..... B63H 21/10; B63H 21/38; F28F 9/06; F28F 21/06

[52] U.S. Cl. ..... 165/44; 165/41; 440/88

[58] Field of Search ..... 165/41, 44; 440/88

[56] References Cited

U.S. PATENT DOCUMENTS

| | | | |
|---|---|---|---|
| 2,258,526 | 10/1941 | Walter | 440/88 |
| 2,382,218 | 8/1945 | Fernstrum | 440/88 |
| 2,612,858 | 10/1952 | Mairs | 440/88 |
| 2,682,852 | 7/1954 | Ruffolo | 440/88 |
| 2,914,012 | 11/1959 | Godfrey et al. | 440/88 |
| 2,976,834 | 3/1961 | Waldron et al. | 440/88 |
| 3,240,179 | 3/1966 | Van Ranst . | |
| 3,650,310 | 3/1972 | Childress | 165/44 |
| 3,841,396 | 10/1974 | Knaebel et al. | 165/44 |
| 4,040,476 | 8/1977 | Telle et al. | 165/44 |
| 4,338,993 | 7/1982 | Fernstrum | 165/44 |
| 4,557,319 | 12/1985 | Arnold | 165/44 |

*Primary Examiner*—John K. Ford
*Attorney, Agent, or Firm*—Dickinson Wright PLLC

[57] ABSTRACT

A marine heat exchanger has a low profile header and cooling tube configuration to minimize drag and maximize heat transfer during use. The cooling tubes extend from at least an underside of the header so that the header vertically disposed cross sectional area is minimized and the cooling tubes are exposed to flowing seawater prior to or along with the headers. The tubes can also extend forwardly of the header to further maximize heat transfer and minimize drag. The header construction is especially adapted for hulls without recesses for header containment.

19 Claims, 2 Drawing Sheets

MARINE HEAT EXCHANGER

FIELD OF THE INVENTION

The present invention is directed to a marine heat exchanger and, in particular, to a heat exchanger having an improved header configuration.

BACKGROUND ART

In the prior art, the use of heat exchangers to cool engine fluids is well known. Various types of exchangers have been proposed, including types to ease installation, reduce drag and improve heat transfer efficiency.

U.S. Pat. No. 4,557,319 to Arnold discloses a marine keel cooler having fore and aft headers that are spaced apart in a parallel relationship and connected by a plurality of tubes or pipes extending normal thereto. The headers are streamlined and fixed to the bottom of a marine vessel with the tubes spaced outwardly from the vessel's bottom and extending longitudinally therewith. In Arnold, the tubes are disposed between the headers.

U.S. Pat. No. 3,841,396 to Knaebel et al. discloses a heat exchanger that performs two basic purposes. First, the heat exchanger provides a passageway through a longitudinal member which integrally incorporates a series of radial disposed fins for enhanced heat exchange. Second, the heat exchanger incorporates flange means integral with the longitudinal member to provide for flush and stable mounting of the device to a supporting surface. The heat exchanger of Knaebel reduces drag on its hull during movement. The cooling tubes of this heat exchanger are disposed between the opposing headers.

U.S. Pat. No. 3,240,179 to Van Ranst discloses a cooler adapted to be used with marine vessels to provide cooling for propulsion engines. This cooler provides relatively large effective heat exchange areas in proportion to the size of the complete unit and has flow characteristics on both internal and external surfaces to provide a highly efficient heat exchange unit. The cooler of Van Ranst has a bottom or outer sheet portion which has a transverse sinuous configuration. The cooler is designed so that the upper or inner ends of the tube convolutions formed by the sinuous outer sheet portion are disposed substantially in the plane of the skin bottom. Thus, the headers of the cooler are disposed within recesses in the vessel hull.

The prior art discussed above, while providing more efficient heat exchange and less drag, is still not without its disadvantages. The cooler of Van Ranst is complex in nature so as to require extensive manufacturing time and is adapted to fit only certain types of vessel hulls, those having recesses. The heat exchangers such as those disclosed in Arnold and Knaebel et al., while being streamlined in shape, compromise heat transfer efficiency with improvements in drag.

Consequently, a need has developed to provide more efficient heat exchangers for marine use. The present invention solves this need by providing a marine heat exchanger that has an improved header configuration which combines both reduced drag and improved heat transfer.

SUMMARY OF THE INVENTION

Accordingly, it is a first object of the present invention to provide an improved marine heat exchanger.

A still further object of the present invention is to provide a heat exchanger having a low profile header construction.

One other object of the present invention is to provide a header construction maximizing the header cooling tube surface area exposed to flowing seawater.

Yet another object of the invention is the use of the inventive heat exchanger on a non-recessed marine hull.

Other objects and advantages of the present invention will become apparent as a description thereof proceeds.

In satisfaction of the foregoing objects and advantages, the present invention, in one embodiment, provides a marine heat exchanger having a pair of headers separated by a plurality of cooling tubes. The headers have connectors such as a pipe nipple or the like to link one of or both of the headers to a marine engine cooling system. A lower plate of the header has a plurality of elongated openings. Each opening is aligned with an elongated opening in each of the respective cooling tubes. A forward end of each cooling tube extends from the lower plate thereby presenting an exposed heat exchange cooling tube surface for increased contact with seawater flowing across one of the headers. The header construction is sized to be low profile in nature to minimize the frontal area of the header which sees the flowing seawater rushing past the heat exchanger.

The cooling tubes can extend downwardly from the lower plate and also forwardly of a front or outer plate portion which forms the header frontal area. In this way, the cooling tubes have even more surface area for more exposure to onrushing seawater.

One or both of the front plate portion and the inner plate portion of the header can be inclined with respect to the lower plate to further minimize the header frontal area and reduce drag.

The heat exchanger is especially adapted for installation on a marine vessel which does not have recesses in the hull to receive a heat exchanger header. In other words, the hull where the heat exchanger is attached follows the normal contours of a typical vessel hull. With the low profile header on this type of a vessel hull, minimal drag with maximum heat transfer is achieved.

The header construction can be used on any type of a marine heat exchanger, including those employing pipe nipples for connection to an engine cooling system and other types which do not employ pipe nipples.

The portion of the cooling tubes extending from either the lower plate or both the lower plate and the outer or front plate are preferably elongated in cross section and have a rounded configuration to further minimize drag during vessel travel in seawater. The tube configuration between the headers could also be rounded if so desired.

BRIEF DESCRIPTION OF THE DRAWINGS

Reference is now made to the drawings of the invention wherein.

DESCRIPTION OF THE PREFERRED EMBODIMENTS

The inventive marine heat exchanger offers significant improvements over existing heat exchangers by combining both improved heat transfer and reduced drag along a vessel hull line. The invention achieves these improved results through the use of a low profile header configuration which exposes the heat exchanger cooling tubing to onrushing seawater during the travel of the marine vessel.

Figure 1:
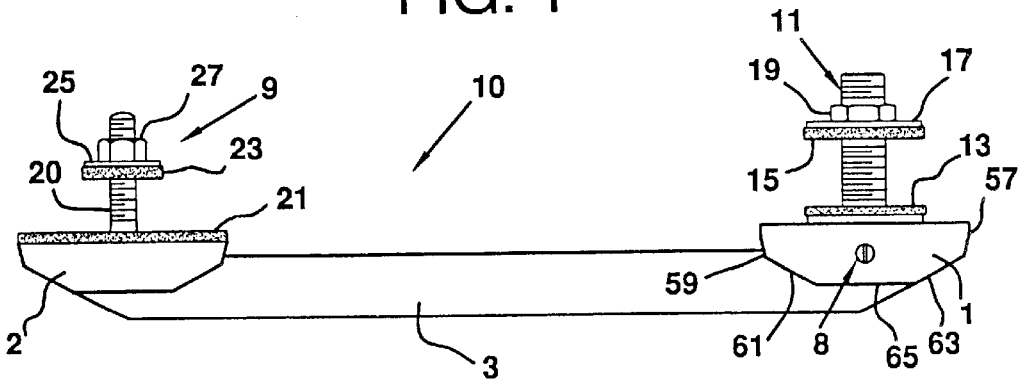
FIG. 1 is a side elevational view of one embodiment of the inventive marine heat exchanger.
Figure 2:
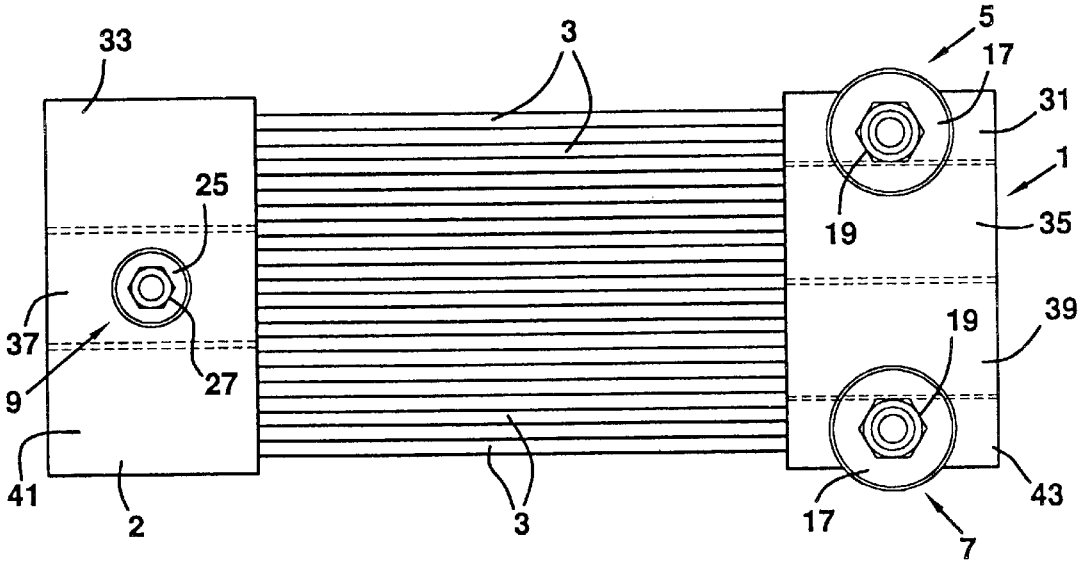
FIG. 2 is a top view of the embodiment of FIG. 1.
Figure 3:
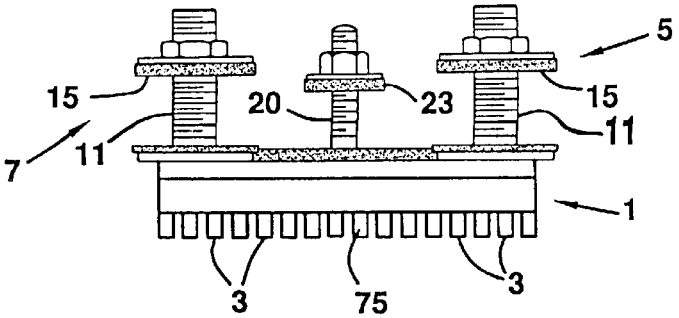
FIG. 3 is an end view of the FIG. 1 embodiment.

One embodiment of the invention is shown in FIGS. 1–3 and is generally designated by the reference numeral 10. The heat exchanger 10 comprises a pair of opposed headers 1 and 2, the headers 1 and 2 being interconnected by a plurality of cooling tubes 3. The cooling tubes 3 are shown with a rectangular configuration but other configurations can be used as would be within the skill of the art.

The header 1 is equipped with a pair of cooling fluid inlet and outlet assemblies 5 and 7. These assemblies provide a means to connect the heat exchanger 10 to a marine engine cooling fluid system for cooling of the fluid thereof. The header 2 includes a coupling assembly 9 which facilitates its attachment to an adjacent vessel hull. The headers 1 and 2 can include drain plugs 8 disposed on the sides thereof.

The inlet and outlet assemblies 5 and 7 each further comprise a threaded nipple 11, one end secured to the header 1. One example of an attachment of a nipple to a header is disclosed in U.S. Pat. No. 4,338,993 to Fernstrum, the teachings thereof herein incorporated by reference in their entirety. These teachings can be used to connect two nipples to one header. Of course, other modes of attachment of the nipples 11 to the header 1 can be used as would be within the skill of the art.

The assemblies 5 and 7 also each include a opposing gaskets 13 and 15, a washer 17 and a nut 19. Similarly, the coupling assembly 9 includes a threaded rod 20 designed to extend through an opening in a vessel hull for attachment of the header 2 to the hull. The assembly 9 also has opposing gaskets 21 and 23, a washer 25 and a nut 27. The gaskets 13, 15, 21 and 23 sandwich a vessel hull (not shown). The washers 17 and 25 and nuts 19 and 27 are used to secure the heat exchanger 10 to the hull. The end of each nipple 11 is then connected to the appropriate inlet and outlet of the marine engine cooling fluid.

The assemblies 5, 7 and 9 shown in FIGS. 1–3 are one example of securing the headers 1 and 2 to the hull to achieve the cooling function of the heat exchanger 10. However, other assemblies can also be used. For example, the inlet and outlet assemblies 5 and 7 could be separated so that one is located on one header with the other arranged on the opposing header. Another example includes that disclosed in the Assignees' application Ser. No. 09/059,376, also incorporated by reference in its entirety. In this application, the headers utilize a flange and mating flange assembly to facilitate connection to a marine vessel and its engine cooling system.

The headers 1 and 2 are appropriately sectioned to permit the cooling fluid flowing into the inlet assembly 5 to travel through the cooling tubes 3 and exit the outlet assembly 7. More particularly, header 1 has an inlet section 31 which is in communication with the section 33 of the header 2. Flow of cooling fluid from section 33 continues to sections 35, 37, 39, 41 and 43 of the headers 1 and 2 to reach the outlet assembly 7. The sections can be formed by plates arranged in the chambers of the headers to direct the cooling fluid back and forth between the headers.

Figure 4:
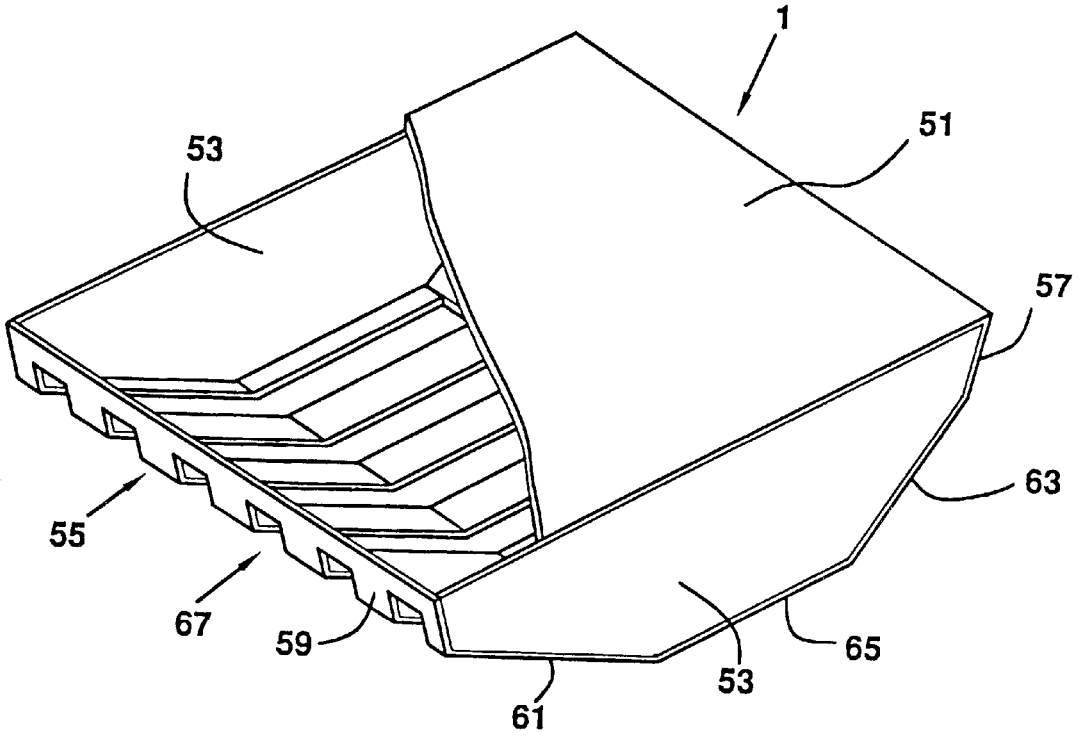
FIG. 4 is a perspective view of the header of FIG. 1 with portions broken away to show greater detail.

With reference to FIG. 4, a portion of the header 1 is shown enlarged to show greater detail. The header 1 includes a top plate 51, a pair of side plates 53 and a bottom plate 55. The bottom plate 55 is shown with five faces. Faces 57 and 59 are generally opposed to each other as are faces 61 and 63. The bottom face 65 is generally opposed to the top plate 51.

The faces 59, 61 and 65 have slots 67 formed therein. The slots 67 provide communication between the header 1 and the cooling tubes 3.

Figure 5:
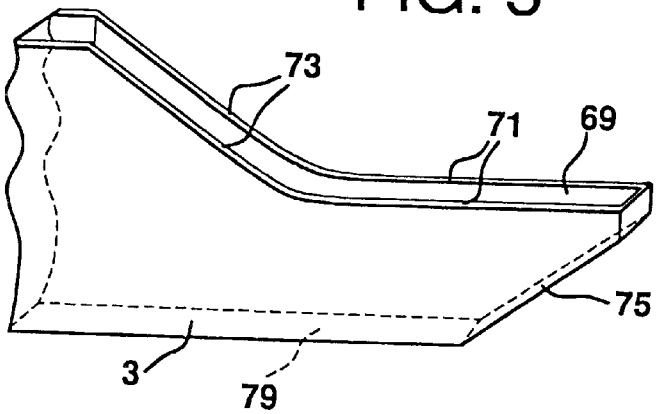
FIG. 5 is a perspective elevational view of a portion of one of the cooling tubes of the FIG. 1 embodiment.

FIG. 5 shows a cooling tube 3 with a channel 69 which is in direct communication with the slot 67 in the header 1. The faces 71 and 73 of the cooling tube 3 attach to the faces 65, 61 and 59 of the header 1, thereby creating a leak-free channel between the header 1 and cooling tube 3. Attachment can be done by any conventional means such as welding, brazing or the like.

By providing a connection between the cooling tubes 3 and the bottom plate 65 of the header, the cooling tubes then have an exposed face 75, see FIG. 3, which is not blocked by the header as is found in the prior art.

The face 75 of the cooling tube 3 is inclined with respect to the bottom face 65 so that the face 75 matches the angling of the face 63 of the header 1 for reduced drag, see FIG. 1.

Figure 6:
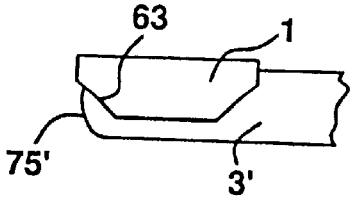
FIG. 6 is a side elevational view of another embodiment of the invention.

The shape of the headers 1 and 2 and cooling tube ends as shown in FIG. 5 can vary from that disclosed in FIG. 1. For example, with reference to FIG. 6, the cooling tube 3' could have a face portion 75' which could extend outwardly from the face 63 of the header 1. In this way, more cooling tube surface area is exposed to onrushing seawater as it passes by the header and cooling tubes 3'. In yet an alternative mode, the faces 61 and 63 of the header 1 could be angled such that ends thereof meet the ends of the top plate 51, such a configuration basically eliminating the faces 57 and 59. In this configuration, the side view of the header is more trapezoidal in shape than the pentagonal shape shown in FIG. 1. This embodiment would provide an even more streamlined header frontal face for reduced drag.

It should be understood that the inventive heat exchanger is designed to interface with vessel hulls wherein the header top plates 51 and the gaskets 13 and 21 interface with a marine vessel outer hull without any recesses or other cavities in the hull outer surface that are sized to receive the entire header or a portion thereof.

The header construction to secure the various plates together as well as to secure the cooling tubes to the plates can be any known joining processes such as brazing, soldering, mechanical fastening or the like.

The invention also includes securing the heat exchanger to a marine vessel. In the inventive method, a marine vessel is selected which does not have cavities or recesses for receiving marine heat exchangers. Instead, the vessel hull has a generally smooth contour with just the openings sized to receive the connecting means of the heat exchanger. For the embodiment shown in FIGS. 1–3, the nipples 11 and rod 20, without the gaskets 15 and 23, the washers 17 and 25 and the nuts 19 and 27, are inserted through the hull openings. The gaskets, nuts and washers are then resecured to the nipples 11 and threaded rod 20 to clamp the heat exchanger 10 to the hull surface.

As such, an invention has been disclosed in terms of preferred embodiments thereof which fulfill each and every one of the objects of the present invention as set forth above and provides a new and improved marine heat exchanger header construction and a combination of the inventive heat exchanger and a marine vessel having a non-recessed hull construction.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In a marine heat exchanger having a pair of headers separated by a plurality of cooling tubes and a pair of connectors to link the cooling tubes to a marine engine cooling system, the improvement comprising at least a lower plate of each header having a plurality of elongated openings, each opening aligned with and sized to accept an elongated opening in each respective cooling tube, a forward end of each cooling tube extending from the lower plate thereby presenting an exposed heat exchange surface for increased contact with seawater flowing across at least one of the headers.

2. The heat exchanger of claim 1, wherein each lower plate is positioned between an outer plate portion and an inner plate portion, the inner plate portions of the headers opposing each other, a portion of each elongated opening located in at least each inner plate portion.

3. The heat exchanger of claim 2, wherein each of the outer and inner plate portions are inclined with respect to the lower plate.

4. The heat exchanger of claim 1 wherein each header further comprises a pair of side plates and a top plate, the lower plate, side plates and top plate forming a header manifold.

5. The heat exchanger of claim 1, wherein a forward end of each cooling tube is inclined with respect to the lower plate.

6. The heat exchanger of claim 1, wherein a forward end of each cooling tube extends from each outer plate portion.

7. The heat exchanger of claim 1, wherein the elongated openings in the lower plate are generally perpendicular to longitudinal axes of the cooling tubes located between the headers.

8. The heat exchanger of claim 2, wherein a portion of each elongated opening in the lower plate is generally perpendicular to longitudinal axes of the cooling tubes located between the headers.

9. The heat exchanger of claim 1, wherein portions of the cooling tubes disposed between the headers are elongated in cross section.

10. The heat exchanger of claim 2, wherein portions of the cooling tubes disposed between the headers are elongated in cross section.

11. A marine vessel and marine heat exchanger combination comprising:

a) a marine vessel having a hull; the hull having a pair of connection sites, a hull surface surrounding each connection site being generally coincident with a remainder of the hull surface;

b) a marine heat exchanger having a pair of headers separated by a plurality of cooling tubes and a pair of connectors linked to a marine engine cooling system, an outer plate portion of each header extending from the hull surface to form a low profile header face, at least a lower plate of each header having a plurality of elongated openings, each opening aligned with and sized to accept an elongated opening in each respective cooling tube, a forward end of each cooling tube extending from the lower plate thereby presenting an exposed heat exchange surface for increased contact with seawater flowing across one of the headers.

12. The combination of claim 11, wherein the outer plate portion of each header is inclined with respect to the lower plate.

13. The combination of claim 11, wherein a forward end of each cooling tube is inclined with respect to the lower plate.

14. The combination of claim 11, wherein the elongated opening of each cooling tube extends into an inner plate portion of each header.

15. The combination of claim 14, wherein the outer plate portion of each header is inclined with respect to the lower plate.

16. The combination of claim 11, wherein both connectors are attached to one header and the headers are sectioned to permit cooling fluid flow from at least the one header to the other header and back to the one header.

17. The combination of claim 14, wherein each cooling tube extends outwardly from the outer plate portion of each header.

18. The combination of claim 11, wherein the elongated openings in the lower plate are generally perpendicular to longitudinal axes of the cooling tubes located between the headers.

19. A method of installing a marine heat exchanger to a marine vessel having at least a pair of hull openings comprising:

a) placing, adjacent a hull of the marine vessel, a marine heat exchanger having a pair of headers separated by a plurality of cooling tubes and a pair of connectors to link the cooling tubes to a marine engine cooling system, wherein at least a lower plate of each header has a plurality of elongated openings, each opening aligned with and sized to accept an elongated opening in each respective cooling tube, a forward end of each cooling tube extending from the lower plate thereby presenting an exposed heat exchange surface for increased contact with seawater flowing across at least one of the headers;

b) attaching the connectors of the marine heat exchanger to a marine engine cooling system through the hull openings so that engine cooling fluid can flow through the headers and cooling tubing to remove heat therefrom.

* * * * *